US007080972B2

(12) United States Patent
Rawlinson

(10) Patent No.: US 7,080,972 B2
(45) Date of Patent: Jul. 25, 2006

(54) AEROFOIL

(75) Inventor: Anthony J Rawlinson, Derby (GB)

(73) Assignee: Rolls-Royce plc, London (GB)

( * ) Notice: Subject to any disclaimer, the term of this patent is extended or adjusted under 35 U.S.C. 154(b) by 349 days.

(21) Appl. No.: 10/602,609

(22) Filed: Jun. 25, 2003

(65) Prior Publication Data

US 2004/0013525 A1 Jan. 22, 2004

(30) Foreign Application Priority Data

Jul. 18, 2002 (GB) ..... 0216709.6

(51) Int. Cl.
*F01D 5/18* (2006.01)

(52) U.S. Cl. ..... 416/97 R

(58) Field of Classification Search ..... 416/96 A, 416/96 R, 97 R; 415/115, 116
See application file for complete search history.

(56) References Cited

U.S. PATENT DOCUMENTS

| | | | | |
|---|---|---|---|---|
| 3,799,696 | A | 3/1974 | Redman | |
| 4,056,332 | A | 11/1977 | Meloni | |
| 4,288,201 | A | 9/1981 | Wilson | |
| 4,767,261 | A | 8/1988 | Godfrey | |
| 5,370,499 | A | 12/1994 | Lee | |
| 5,752,801 | A | 5/1998 | Kennedy | |
| 6,382,908 | B1 * | 5/2002 | Keith et al. | 415/115 |
| 6,612,811 | B1 * | 9/2003 | Morgan et al. | 416/97 R |

FOREIGN PATENT DOCUMENTS

| | | |
|---|---|---|
| EP | 1 052 373 A | 11/2000 |
| GB | 2 260 166 A | 4/1993 |
| WO | WO 02/092970 A | 11/2002 |

* cited by examiner

*Primary Examiner*—Edward K. Look
*Assistant Examiner*—Nathan Wiehe
(74) *Attorney, Agent, or Firm*—W. Warren Taltavull; Manelli Denison & Selter PLLC

(57) ABSTRACT

An aerofoil 1 includes cooling channels 2, 3, 4, 5 with transfer passages 8 between adjacent channels 2, 3, 4, 5. In normal operation, the constriction in each cooling channel 2, 3, 4, 5 ensures direct through coolant airflow in the direction of arrowheads A. However, when a channel 4 is blocked by a blockage 9 airflow in adjacent channels 2, 5 is forced through the transfer passages 8 in order to provide airflow in the blocked channel 4 and facilitate cooling. This blocked channel airflow is in the direction of arrowheads B. Generally, the cross-section of the transfer passages 8 is determined for conformity with the outlet 7 cross-section of the channel 4 in order to achieve substantial coolant flow balance across the coolant channels 2, 3, 4, 5 of the aerofoil 1.

7 Claims, 1 Drawing Sheet

AEROFOIL

FIELD OF THE INVENTION

The present invention relates to aerofoils and more particularly to appropriate cooling of such aerofoils when cooling channels become blocked.

BACKGROUND OF THE INVENTION

Aerofoils are used within turbine engines and are subjected to high temperatures such that adequate cooling is required to maintain their operability. Typically, cooling channels are provided through the aerofoil in which coolant, normally air, flows in order to cool the airflow. Unfortunately, these internal cooling channels are prone to blockage by dirt or other contaminants.

Previous approaches to avoiding coolant channel blockage have included channel oversizing, over specifying the number of cooling channels required and incorporation of dirt separation or filtration devices. These approaches inherently result in significant efficiency penalties along with additional fabrication and manufacturing costs.

SUMMARY OF THE INVENTION

In accordance with the present invention there is provided an aerofoil for a turbine engine, the aerofoil comprising cooling channels of decreasing cross-section with a transfer passage between adjacent cooling channels in order to provide coolant flow into a channel if normal coolant flow is restricted upstream of the transfer passage.

Preferably, cooling channels are wedge shaped from an inlet to an outlet to provide the decreasing cross-section to coolant flow. Generally, transfer passages will be provided in both sides of each cooling channel. Normally, the or each transfer passage cross-section accumulation is determined for substantial conformity with their coolant channel outlet cross-section for coolant flow balance through the aerofoil. Possibly, more than one transfer passage will be provided between adjacent cooling channels. Typically, transfer passages will have a one millimeter diameter. Possibly, transfer passages are staggered to improve heat transfer and/or mechanical strength in the aerofoil. Normally, transfer passages are located towards an upstream end of each cooling channel. Possibly, the relative cross-section and distribution of transfer passages between adjacent cooling channels and/or through the length of the aerofoil may be different in order to facilitate desired cooling of the aerofoil.

Also in accordance with the present invention there is provided a turbine engine including an aerofoil as described above.

BRIEF DESCRIPTION OF THE DRAWINGS

An embodiment of the present invention will now be described by way of example only with reference to the accompanying drawing, FIG. 1, which is a schematic representation of cooling channels in an aerofoil.

DETAILED DESCRIPTION OF THE INVENTION

Figure 1:
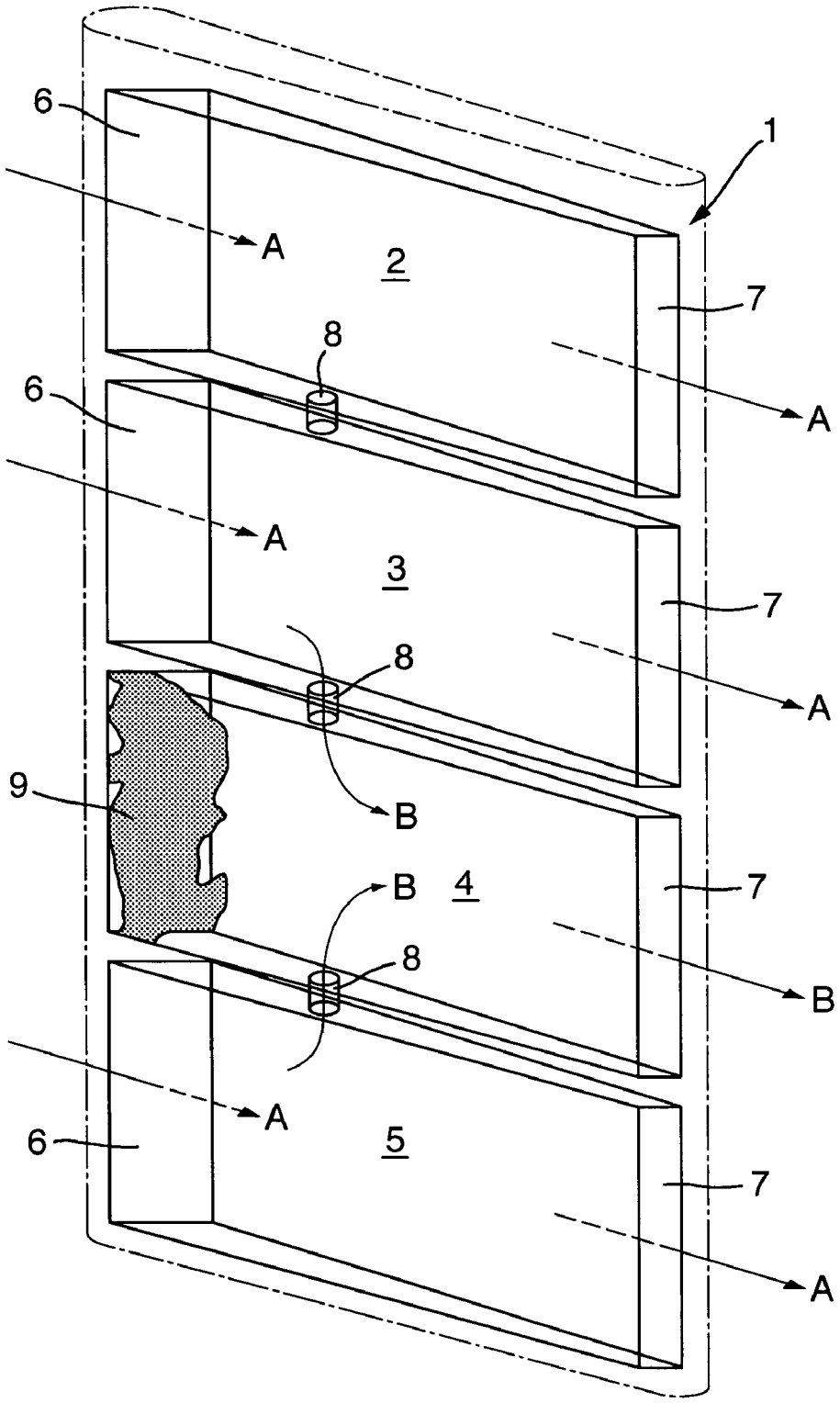

Referring to the drawing FIG. 1 which provides a schematic representation of an aerofoil 1 including cooling channels 2, 3, 4, 5. Generally, the cooling channels 2, 3, 4, 5, have a wedge configuration such that an inlet end 6 has a significantly greater cross-section than an outlet end 7. Thus, each of the cooling channels 2, 3, 4, 5 has a decreasing cross-section presented to an airflow in the direction of the arrowheads. The rate of coolant airflow (arrowheads A) through the channels 2, 3, 4, 5 will be dependent upon turbine engine speed and cooling requirements. It will be appreciated that heating of the aerofoil 1 will be dependant upon turbine engine operation or condition and so the degree of cooling required may be variable. Nevertheless, the aerofoil 1 will typically require on-going cooling whilst operational and any failure will compromise aerofoil performance.

In the present aerofoil 1 transfer passages 8 are provided between adjacent cooling channels 2, 3, 4, 5. In normal use, as a result of the equalization of airflow pressure in the adjacent channels 2, 3, 4, 5 there will be negligible, if any, transfer airflow through the passages 8 and therefore between the channels 2, 3, 4, 5. However, when a channel such as cooling channel 4 is blocked by a blockage 9 there is a diminution in the flow pressure in that channel 4 if only partly blocked or an absence of coolant airflow pressure if completely blocked. In such circumstances, the coolant airflow pressure in adjacent coolant channels 3, 5 will force air through the passages 8 in the direction of arrowheads B in order to provide cooling in that channel 4. The effective constriction in the channels 3, 4, 5 due to decreasing cross-section effectively pressurizes the coolant airfiows in these channels 3, 4, 5 and the desire to equalize pressure through the passage 8 substantially drives air into channel 4 and renders any venturi effect due to the airflow past the passaqe 8 in the respective channels 3, 5 irrelevant.

It will be noted that airflow in channel 2 may not be driven through the respective passage 8 between that channel 2 and its adjacent channel 3 if there is substantially the same airflow pressure in these channels 2, 3. However, if the leakage of air though the respective passage 8 between channels 3 and blocked channel 4 is sufficient to diminish the flow pressure in channel 3 then the balance in airflow pressure between channel 2 and channel 3 will be disturbed and there may be some airflow through the respective passage 8 between the channels 2, 3 to compensate. There may be a cascade of transfer airflow in the passages 8 progressively decreasing away from the blocked channel.

As can be seen in FIG. 1 transfer passages 8 are provided on either side of central coolant channels 2, 3 whilst outer coolant channels 2, 5 only have one transfer passage 8 with their adjacent coolant channel 2, 3. In such circumstances, central coolant channels 2, 3 can receive coolant airflow through respective passages 8 from either adjacent channel when blocked whilst outer channels 2, 5 will only receive coolant flow through one passage 8 when blocked. This situation may be acceptable if the outer portions of the aerofoil 1 are subjected to less heating and therefore less coolant is required in the outer channels 2, 5. Alternatively, these outer coolant channels 2, 5 could incorporate more than one transfer passage with adjacent coolant passages in order that potentially greater coolant flow may pass through these additional transfer passages to improve cooling. Nevertheless, it will be appreciated that by having a wedge cross-section configuration each channel 2, 3, 4, 5 is diminishing from its inlet end 6 to its outlet end 7 so that it may be difficult to accommodate several transfer passages in the length of the channels 2, 3, 4, 5. Furthermore, it should be appreciated that incorporation of transfer passages should not appreciably diminish the mechanical strength of the aerofoil 1.

As illustrated in FIG. 1, typically the transfer passages 8 will comprise round holes between adjacent channels 2, 3, 4, 5. Normally, these holes will have a diameter of approximately 1 millimeter. Alternatively, the transfer passages may have different cross-sections including oval, lozenge or square.

Retention of mechanical strength in the aerofoil is important. Thus, in order to break any potential structural lines of weakness, the transfer passages in adjacent channels may be staggered out of alignment with each other. Furthermore, rather than being axially aligned within the aerofoil 1 each passage could be slanted relative to the major axis of the aerofoil to facilitate flow guidance or scoop pickup when required between adjacent coolant channels due to a blockage of one or more such coolant channels. Furthermore, these passages could have a herringbone or arrowhead arrangement of intersecting slope sections to the major axis of the aerofoil 1.

As indicated previously, accommodation of the transfer passages 8 may be difficult due to the thin nature of the aerofoil 1 and compounded by the wedge cross-section configuration. Thus, normally the transfer passages 8 will be located towards an upstream end of the coolant channels 2, 3, 4, 5, that is to say towards the inlet ends 6.

The cross-section provided by respective transfer passages 8 will typically be determined for substantial conformity with the outlet end 7 cross-section of each coolant channel 2, 3, 4, 5. Such an arrangement should ensure coolant flow balance between the respective coolant channels 2, 3, 4, 5. In such circumstances, the aerofoil 1 will be substantially cooled throughout its length with substantially the same or a desired cooling effect through each of the channels 2, 3, 4, 5 irrespective of blockage 9.

As indicated previously, transfer passages 8 during normal open operation for all channels will be redundant in terms of limited, if any, transfer airflow between the channels. In such circumstances, the relatively high pressure and airflow rates through the channels along with the perpendicular presentation of that airflow should limit the possibility of dirt blocking these transfer passages 8. In any event, if the transfer passage 8 was substantially blocked during normal operation this blockage would not be compacted and so should be relatively loose. Furthermore, if any inlet end were blocked then there would be no back up pressure behind such a loose blockage in a transfer passage and the adjacent airflow pressure may drive the blockage out or through the transfer passage and out of the blocked channel.

The present aerofoil 1 will generally be used in a turbine engine. The operation of turbine engines is well known by those skilled in the art. It will be appreciated that aerofoil fins are subjected to substantial heating during their operation but are required to retain substantially consistent structural configuration and strength. In such circumstances, an aerofoil must remain within specified temperature ranges in order to retain structural conformity and strength for consistent turbine engine operation. Blockage of cooling channels as described previously will alter cooling within the aerofoil both collectively and locally about the blocked cooling channel. In such circumstances, the aerofoil may rapidly deteriorate in operation and require potentially expensive replacement. The present invention also includes a turbine engine including an aerofoil as described previously such that greater confidence can be provided that each individual aerofoil will be adequately cooled such that planned and preventative replacement of aerofoils for operational confidence can be extended over longer periods of time or service history.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An aerofoil for a turbine engine, the aerofoil comprising cooling channels of decreasing cross-section with a transfer passage between adjacent cooling channels in order to provide coolant flow into a channel if normal coolant flow is restricted upstream of the transfer passage wherein the transfer passage has a cross-section determined for conformity with the outlet cross-section of a respective coolant channel for substantial coolant flow balance across the coolant channels of the aerofoil wherein the cooling channels are wedge shaped from an inlet to an outlet to provide the decreasing cross-section to coolant flow and wherein each transfer passage is located towards an upstream end of its respective cooling channel and in a wall that is otherwise imperforate.

2. An aerofoil as claimed in claim 1 wherein transfer passages are provided on both sides of each cooling channel.

3. An aerofoil as claimed in claim 1, wherein each transfer passage has a diameter of approximately 1 millimeter.

4. An aerofoil as claimed in claim 1, wherein each transfer passage has one of a round or oval cross-section.

5. An aerofoil as claimed in claim 1, wherein each transfer passage is substantially perpendicular to the respective coolant channels between which it extends.

6. An aerofoil as claimed in claim 1, wherein the transfer passages are staggered relative to the major axis of the aerofoil in order to improve at least one of the heat transfer and mechanical strength of the aerofoil.

7. A turbine engine including an aerofoil as claimed in claim 1.

* * * * *